United States Patent [19]

Penniman

[11] 4,260,274

[45] Apr. 7, 1981

[54] BINDER WITH MAGAZINE STORAGE AND HAND TOOL

[75] Inventor: Scott R. Penniman, Lansdale, Pa.

[73] Assignee: REP Industries, Inc., Lansdale, Pa.

[21] Appl. No.: 141,012

[22] Filed: Apr. 17, 1980

[51] Int. Cl.[3] ..... B42F 13/12

[52] U.S. Cl. ..... 402/80 R; 402/53; 402/73; 7/138

[58] Field of Search ..... 402/51, 53, 58, 59, 402/73, 80 R; 145/61 J, 61 L; 7/167, 165, 138

[56] References Cited

U.S. PATENT DOCUMENTS

| | | | |
|---|---|---|---|
| 1,416,461 | 5/1922 | Hance | 7/138 |
| 1,731,454 | 10/1929 | Dawson | 402/50 |
| 2,335,047 | 11/1943 | Ellis | 402/59 X |
| 4,126,402 | 11/1978 | Penniman | 402/53 |

*Primary Examiner*—Paul A. Bell
*Assistant Examiner*—John S. Brown
*Attorney, Agent, or Firm*—Seidel, Gonda, Goldhammer & Panitch

[57] ABSTRACT

A hollow binder for a book having removable pages such as a ledger is used for storage of threaded posts. Each of the posts are coaxial and threaded to one another. One of the posts is adapted by itself or in conjunction with other posts to be a hand tool for threading or unthreading of posts.

4 Claims, 3 Drawing Figures

FIG. 1
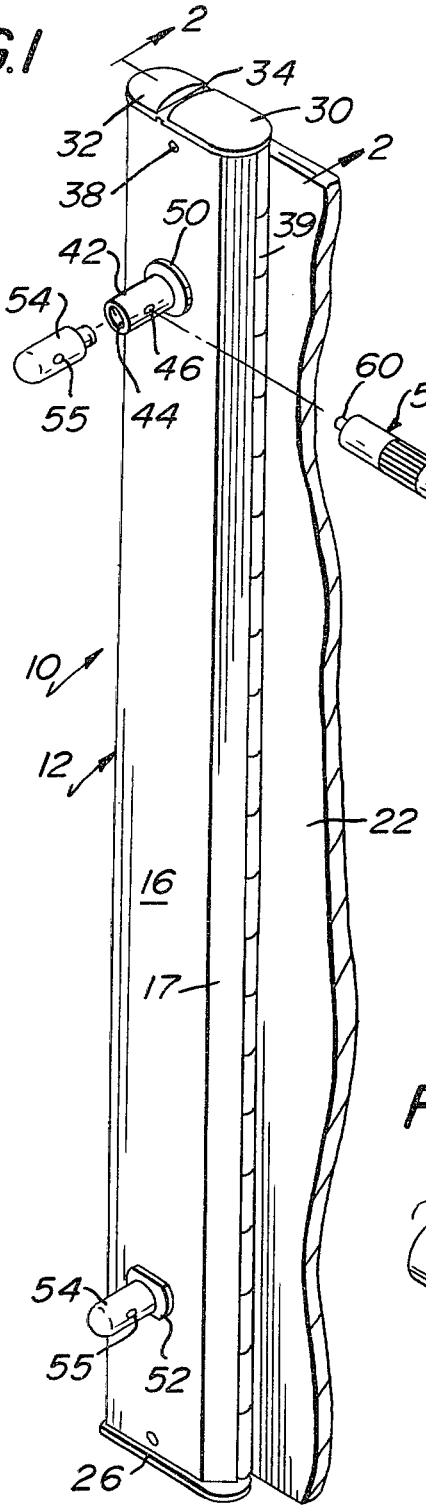
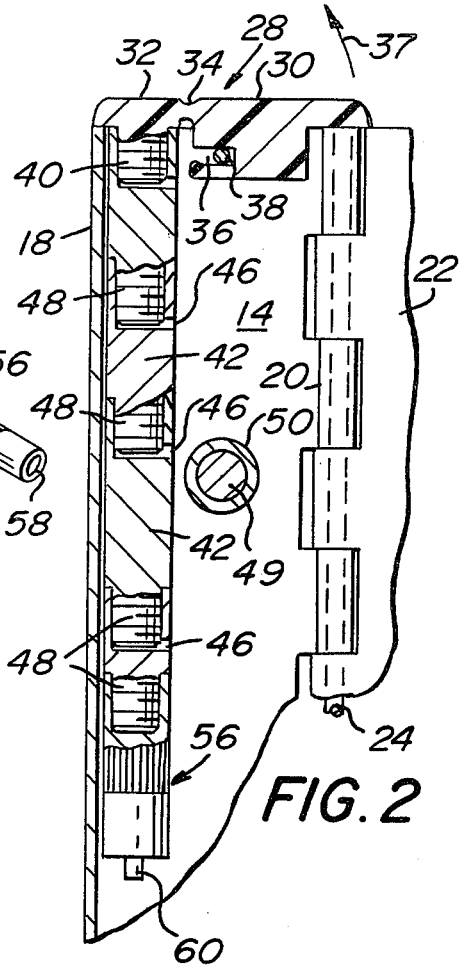
FIG. 2
FIG. 3
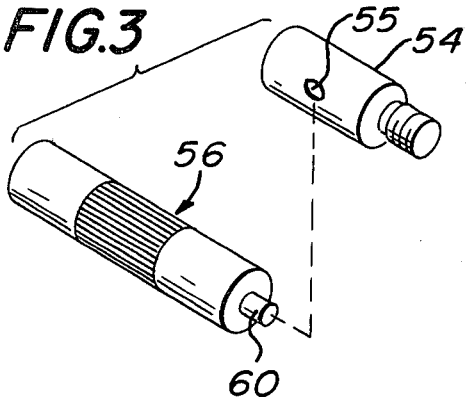

BINDER WITH MAGAZINE STORAGE AND HAND TOOL

BACKGROUND

The present invention is an improvement over the binder disclosed in U.S. Pat. No. 4,126,402. If the threaded posts in a ledger are not frequently used by being threaded and unthreaded, they are difficult to unthread using only finger pressure. The present invention is directed to a solution of this problem and includes a hand tool which may be incorporated into the magazine storage along with posts as disclosed in said patent.

SUMMARY OF THE INVENTION

The binder of the present invention includes a hollow elongated housing which is closed at opposite ends. One end of the housing is closed by a removable cap. A plurality of posts are connected end to end and are disposed within said housing. One of the posts is connected to said cap so that all posts are removed when said cap is removed. A means is provided on one side face of the housing to which one of said threaded posts may be attached. The string of threaded posts includes a hand tool which may be used as a lever to thread or unthread posts.

It is an object of the present invention to provide a novel binder having magazine storage for threaded posts and a hand tool in a manner which is simple, reliable, and solves a problem with respect to threading or unthreading cylindrical posts.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of the binder housing and a portion of a rear cover.

FIG. 2 is a sectional view taken along the line 2—2 in FIG. 1.

FIG. 3 is an exploded perspective view of the hand tool and one of the posts.

DETAILED DESCRIPTION

Referring to the drawing in detail, wherein like numerals indicate like elements, there is shown a binder with a magazine storage in accordance with the present invention designated generally as 10. The binder includes a hollow elongated metal housing 12 having a straight side wall 14 and a straight side wall 16 interconnected by a curved wall 18. Wall 14 is the outer wall of the housing and is wider than wall 16. Wall 16 terminates in an angled wall 17. Wall 14 terminates in spaced hinges 20.

The hinges 20 facilitate coupling the binder to a rear cover 22 by way of a hinge pin 24. Other equivalent structure may be utilized to facilitate coupling the rear cover 22 to the wall 16 of the housing 12.

The housing 12 is closed at its ends by caps 26 and 28. Cap 26 is fixedly secured to the housing in any suitable manner. Cap 28 is removable. As shown more clearly in FIG. 2, the cap 28 includes body portions 30 and 32 interconnected by a web 34. Web 34 acts as a hinge for interconnecting the body portions 30, 32.

The body portion 32 has a slot 36 in a face thereof which extends towards the wall 18. A pin 38 extends between the walls 14 and 16 and preferably is in the form of a rivet. The body 30 and its groove 36 are dimensioned so that the body 30 may be pivoted about the web 34 in the direction of arrow 37 to effect disengagement between the cap 28 and the pin 38. Thereafter, the cap 28 is readily removable. Cap 28 is preferably made from a polymeric plastic material which has some flexibility whereby the web 34 may act as a hinge but is generally a hard plastic material.

The end caps 26, 28 conform generally to the cross-sectional shape of the housing 12. Due to the angled walls 17, there is provided a lip portion 39 on the body 30 against which a person's finger may apply pressure in a direction of arrow 37 to remove the cap 28. The lip portion 39 corresponds to the shape of exposed portion of cap 26 at the lower end of FIG. 1.

The body portion 32 of the cap 38 has a threaded boss 40 on its inner face. A plurality of discrete threaded posts 42 are provided for storage within the housing 12. The posts 42 are identical except for length. Each post 42 includes a threaded hole 44 at one end and a threaded stud 48 at the other end. The threaded holes and studs are of the same diameter whereby posts may be connected to one another end to end. Each of the posts 42 has a transverse hole 46 adjacent the blind end of the threaded hole 44 to vent air when coupling two posts together and to provide means into which a hand tool may be inserted to loosen or tighten the posts.

Hollow inserts or rivets 50, 52 extend between the walls 14, 16 of the housing 12. The rivets 50, 52 have threads on their inner periphery. Posts 54 are solid, rounded on one end, and have a stud on the opposite end which is adapted to be coupled to the threads on the inner periphery of the rivets 50, 52. Because the posts 54 are rounded on one end and cylindrical, they are difficult to remove using only one's fingers if they are stuck. A front cover may be attached to the posts 54 in any conventional manner while overlying the rear cover 22.

A tool 56 is provided and has a threaded hole 58 at one end for receiving a stud on the last one of the posts 42 as shown more clearly in FIG. 2 or for connection to boss 40. At its opposite end, the tool 56 has a projection 60. The projection 60 may be cylindrical and is of a diameter so that it may be received in any one of the holes 46 or in a hole 55 in a post 54. If desired, the tool 56 may have serrations on its outer periphery or knurling or the like. If a post 54 is stuck, the cap 28 is removed and the string of posts 42 the tool 56 at one end is used as a lever to rotate the post 54 after first inserting the projection 60 into the hole 55.

When additional pages are to be added to a ledger between the front and rear covers thereof, and the length of the posts 54 are insufficient to accommodate such pages, the following procedure may be used. The front cover is removed. End cap 28 is removed. All of the posts are used in combination with the tool 56 to loosen any of the posts 54 which cannot be loosened by hand. The number of posts 42 needed are then unthreaded from the remainder of the string. The new posts are threaded to the rivets 50, 52 or any previous posts 42 to increase the capacity of the ledger. Posts 54 are then threaded to the posts 42. The remaining posts are threaded together into a string and reinserted into the magazine storage by way of the cap 28. Since all of the posts 42 and the tool 56 are threaded end to end, they do not rattle within the housing 12. Also, the tool 56 is always handy whereby it is not necessary to look for some other hand tool when having difficulty with one or more of the posts. It is not necessary to use all of the posts 42 and tool 56 as a lever. That is, the tool 56 may be unthreaded from the adjacent posts 42 and used by itself as a lever.

The present invention may be embodied in other specific forms without departing from the spirit or essential attributes thereof and, accordingly, reference should be made to the appended claims, rather than to the foregoing specification, as indicating the scope of the invention.

I claim:

1. In a binder the improvement comprising a hollow elongated housing closed at its ends, one end of said housing being closed by a removable cap, a plurality of threaded posts connected end to end in said housing, one of said posts being connected to said cap, a tool having one end connected to the post remote from said cap, the other end of said tool having a projection adapted to engage a mating structure on a post to facilitate rotation of a post about its axis, whereby removal of the cap will facilitate removal of all of the posts and said tool therewith.

2. In a binder in accordance with claim 1 wherein said mating structure is a radially disposed hole.

3. In a binder in accordance with claim 1 wherein said tool has a diameter corresponding to the diameter of said posts, and said one end of said tool being connected to the next adjacent post by having a threaded recess on said one end of the tool for receiving a threaded stud on the next adjacent post.

4. In a binder in accordance with claim 3 wherein said threaded recess on said tool is adapted to be threadly coupled to a boss on said cap in the absence of said threaded posts.

* * * * *